US011613859B2

(12) United States Patent
Thomson, Jr.

(10) Patent No.: US 11,613,859 B2
(45) Date of Patent: Mar. 28, 2023

(54) SYSTEM TO REMOVE SNOW AND ICE FROM PAVEMENT AND METHOD THEREFOR

(71) Applicant: Richard F. Thomson, Jr., Hobart, WI (US)

(72) Inventor: Richard F. Thomson, Jr., Hobart, WI (US)

( * ) Notice: Subject to any disclaimer, the term of this patent is extended or adjusted under 35 U.S.C. 154(b) by 183 days.

(21) Appl. No.: 16/869,551

(22) Filed: May 7, 2020

(65) Prior Publication Data

US 2020/0347565 A1 Nov. 5, 2020

Related U.S. Application Data

(63) Continuation-in-part of application No. 16/402,160, filed on May 2, 2019, now abandoned.

(51) Int. Cl.

| | |
|---|---|
| ***E01H 5/12*** | (2006.01) |
| ***E01H 5/00*** | (2006.01) |
| ***E01H 5/06*** | (2006.01) |
| ***E01H 10/00*** | (2006.01) |
| ***E01H 5/09*** | (2006.01) |
| *E01H 5/10* | (2006.01) |

(52) U.S. Cl.

CPC ..... *E01H 5/00* (2013.01); *E01H 5/061* (2013.01); *E01H 5/098* (2013.01); *E01H 5/12* (2013.01); *E01H 10/007* (2013.01); *E01H 5/10* (2013.01)

(58) Field of Classification Search

CPC .... E01H 5/00; E01H 5/04; E01H 5/06; E01H 5/07; E01H 5/12

See application file for complete search history.

(56) References Cited

U.S. PATENT DOCUMENTS

| | | | | |
|---|---|---|---|---|
| 980,993 | A | 1/1911 | Mott | |
| 1,204,772 | A | 11/1916 | Hornecker | |
| 1,242,433 | A | 10/1917 | Friedman | |
| 1,468,977 | A | 9/1923 | Mario | |
| 1,602,476 | A | 10/1926 | Ballard | |
| 1,742,968 | A | 1/1930 | Polak | |
| 2,156,066 | A * | 4/1939 | Royer | E01H 5/12 15/93.1 |
| 2,599,098 | A | 6/1952 | Flynn | |
| 2,783,554 | A | 3/1957 | Harry | |

(Continued)

FOREIGN PATENT DOCUMENTS

| | | | |
|---|---|---|---|
| CH | 552 991 | * | 8/1974 |
| CH | 598 423 | * | 4/1978 |
| DE | 2 400 437 | * | 1/1974 |

*Primary Examiner* — Gary S Hartmann

(74) *Attorney, Agent, or Firm* — Amundsen Davis, LLC

(57) ABSTRACT

A system that is towed behind a vehicle to remove snow and ice from pavement. The system includes a trailer. The trailer includes a longitudinal substantially rigid frame structure, a trailer hitch connected to a front end of the trailer for selective connection-disconnection to the vehicle, and a suspension appliance connected to a rear portion of the trailer to separate at least a rear portion of the frame structure from the pavement. At least two additive snow and ice removal tools are connected to the frame structure and located underneath the trailer and over the pavement, each of the tools enabling a different type of snow and ice removal from the pavement when towing the system behind the vehicle to remove snow and ice from the pavement.

23 Claims, 8 Drawing Sheets

(56) References Cited

U.S. PATENT DOCUMENTS

| | | | |
|---|---|---|---|
| 2,877,762 | A | 3/1959 | Frank |
| 3,066,428 | A | 12/1962 | James |
| 3,304,632 | A | 2/1967 | Joseph et al. |
| 3,346,973 | A | 10/1967 | Meyer et al. |
| 3,404,470 | A | 10/1968 | James |
| 3,447,188 | A | 6/1969 | Maasberg |
| 3,452,459 | A | 7/1969 | Campion |
| 3,464,128 | A | 9/1969 | Krickovich |
| 3,484,961 | A | 12/1969 | Coslowsky |
| 3,619,918 | A | 11/1971 | Morin |
| 3,703,932 | A | 11/1972 | Tuttle et al. |
| 3,766,586 | A | 10/1973 | Krickovich |
| 3,800,884 | A | 4/1974 | Estes |
| 3,803,732 | A | 4/1974 | Moreno |
| 3,893,248 | A | 7/1975 | Young |
| 3,908,289 | A | 9/1975 | Ross |
| 4,071,966 | A | 2/1978 | Cohen |
| 4,096,652 | A | 6/1978 | Raines et al. |
| 4,164,820 | A | 8/1979 | Krickovich |
| 4,226,034 | A | 10/1980 | Benjamin et al. |
| 4,244,662 | A | 1/1981 | Olson |
| 4,369,590 | A | 1/1983 | Miller |
| 4,506,465 | A | 3/1985 | Johnson |
| 4,571,860 | A | 2/1986 | Long |
| 4,785,561 | A | 11/1988 | Swanson |
| 5,245,771 | A | 9/1993 | Walsh |
| 5,365,681 | A | 11/1994 | Miranda |
| 5,392,538 | A | 2/1995 | Geerligs et al. |
| 5,400,859 | A | 3/1995 | Harrell |
| 5,469,645 | A | 11/1995 | Aiken |
| 5,561,921 | A | 10/1996 | Vanderlinden |
| 5,588,231 | A | 12/1996 | Mavrianos |
| 5,630,286 | A | 5/1997 | Vanderlinden |
| 5,787,613 | A | 8/1998 | Derome |
| 5,953,837 | A | 9/1999 | Clifford |
| 5,974,703 | A | 11/1999 | Cadarette |
| 6,070,343 | A | 6/2000 | Sheldon |
| 6,151,809 | A | 11/2000 | Altheide |
| 6,305,105 | B1 | 10/2001 | Lowman |
| 6,453,582 | B1 | 9/2002 | Fulton, III |
| 6,845,570 | B2 | 1/2005 | Paterson |
| 6,904,708 | B2 | 6/2005 | Rogers |
| 7,367,407 | B2 | 5/2008 | Lannert |
| 8,037,624 | B2 * | 10/2011 | McKeown ..... E01H 5/106 37/197 |
| 8,365,346 | B2 | 2/2013 | Coppola et al. |
| 8,776,406 | B2 | 7/2014 | Stephan |
| 9,315,210 | B2 * | 4/2016 | Sears ..... B62D 13/00 |
| 9,732,489 | B1 | 8/2017 | Whitney |
| 2004/0074114 | A1 | 4/2004 | Rogers |
| 2006/0143952 | A1 | 7/2006 | Lannert |
| 2014/0290101 | A1 | 10/2014 | Arsenault et al. |
| 2016/0053452 | A1 | 2/2016 | Treglown |
| 2016/0356010 | A1 | 12/2016 | Wilkinson |
| 2017/0152639 | A1 | 6/2017 | Cho |

* cited by examiner

SYSTEM TO REMOVE SNOW AND ICE FROM PAVEMENT AND METHOD THEREFOR

CROSS-REFERENCE TO RELATED APPLICATION

This application is a continuation-in-part of U.S. Non-provisional application Ser. No. 16/402,160, filed May 2, 2019, titled: DEVICE, APPARATUS, SYSTEM AND METHOD FOR IMPLEMENTING PLOWING, REMOVAL, MELTING AND CLEARING OF SNOW AND ICE FROM PAVEMENT UTILIZING A TOWED SNOW AND ICE REMOVAL TRAILER.

TECHNICAL FIELD

The present invention relates to a system and method for implementing plowing, removal, melting or clearing of snow and ice (and combinations thereof) from the surface or area of pavement including roadways, streets and driveways. More specifically, the present invention relates to snow and ice removal by a system towed behind any type of motor vehicle.

BACKGROUND

Winter months bring heavy snowfall, sleet, hail, ice and precipitation which impedes and can block the flow of traffic on roadways/streets/driveways and prevent individuals from exiting/entering garages and driveways from which their vehicles are stored. Municipalities, private companies and individuals are tasked with clearing roadways, streets and driveways of snow and ice in order to allow for vehicle traffic to flow and vehicles to exit/enter driveways and garages, parking lots, etc. Current snow and ice clearing technology and techniques are inefficient in several ways.

Current snow clearing technology and techniques are focused on displacing snow and ice, rather than removing it. Current snow and ice clearing techniques will skim the top layers of snow which, along with the compaction from traffic flow, results in the lower layers of snow and ice packing down and making the surface slippery, difficult to navigate and problematic to remove from the roadways. Slippery roadways are unsafe and can result in accidents/injuries for drivers, vehicle crashes and stranded motorists.

Current snow clearing technology and techniques utilize a front of the vehicle for displacing snow and ice, and this often does not completely remove all layers of snow and ice from roadways; thus often requiring: multiple operators, multiple snow clearing vehicles and multiple passes by the snow clearing vehicle(s) in order to more completely clear off roadways of snow and ice, which is costly in the form of time, money, gas and emissions.

Some prior art devices have been focused on either individual use or heavy duty, large-scale municipal use. For example, such has provided for a passenger vehicle, usually an automobile, to tow a single shovel or plow/blade/mold-board in front of or behind the vehicle, which would only be effective to clear a driveway or two, for instance. As another example, such has provided for heavy duty, large-scale municipal snow clearing vehicles or towed trailers for large-scale industrial snow clearing use which are expensive and cost-prohibitive for individuals and private companies.

SUMMARY

To address one or more of the deficiency discussed above, there is a need for a system and method that improves current technology or techniques for plowing, melting and clearing, namely removing, snow and ice from pavement, including roadways, streets and driveways.

In view of the foregoing, the disclosure is a system that is towed behind a vehicle to remove snice from pavement. The system includes a trailer. The trailer includes a frame structure, a trailer hitch and a suspension appliance. The frame structure is a longitudinal substantially rigid frame structure with torqueing capability in response to towing of the system when removing snice. The trailer hitch is connected to a front end of the trailer and the trailer hitch enables selective connection-disconnection to the vehicle and separation of a front portion of the frame structure from the pavement when connected to the vehicle. A suspension appliance is connected to a rear portion of the trailer to separate at least a rear portion of the frame structure from the pavement. The suspension appliance includes at least one axel having at least two wheels rotatably secured thereto and capable of moving over the pavement and at least one strut securing the axel to the frame structure. At least two additive snice removal tools are connected to the frame structure and located underneath the trailer and over the pavement. Each of the removal tools is enabling a different type of snice removal from the pavement when towing the system behind the vehicle to remove snice from the pavement.

Also described herein is a method of using a system behind a vehicle for removing snice from pavement. One step of the method is towing a trailer behind the vehicle. The trailer includes a longitudinal substantially rigid frame structure with torqueing capability in response to towing of the trailer when removing snice. Another step is selectively connecting-disconnecting the trailer to the vehicle and separating a front portion of the frame structure from the pavement when the trailer is connected to the vehicle. Yet another steps is providing a suspension appliance to a rear portion of the trailer to separate at least a rear portion of the frame structure from the pavement. The suspension appliance includes at least one axel having at least two wheels rotatably secured thereto and capable of moving over the pavement and at least one strut securing the axel to the frame structure. Still another step is enabling at least two different types of additive snice removal from the pavement when towing the trailer behind the vehicle to remove snice from the pavement.

Other embodiments of the system can include various additional and alternative features as described herein.

As used herein, "snice" means snow, ice and all types in between, and combinations thereof, that could include any form of solid-phase water from slightly solid, to very rigidly solid and pieces and parts of snow and ice in its various types, that is located on pavement and can be removed therefrom.

As used herein, "pavement" means roadways, streets, driveways and any surface where it is desirable to remove snice to aid the passing of vehicles or persons over that surface more safely.

As used herein, "connected" (and formatives thereof) means the components or parts are attached to each other and would require a force to separate them.

As used herein, "directly" means there is substantially no intervening components or function that adversely impacts the relatedness of the two components or their functions.

As used herein, "indirectly" means there is some intervening components or function that separates the relatedness of the two components or their functions.

BRIEF DESCRIPTION OF THE DRAWINGS

The invention may be more completely understood in consideration of the following detailed description of various embodiments of the invention in connection with the accompanying drawings, in which.

Figure 1:
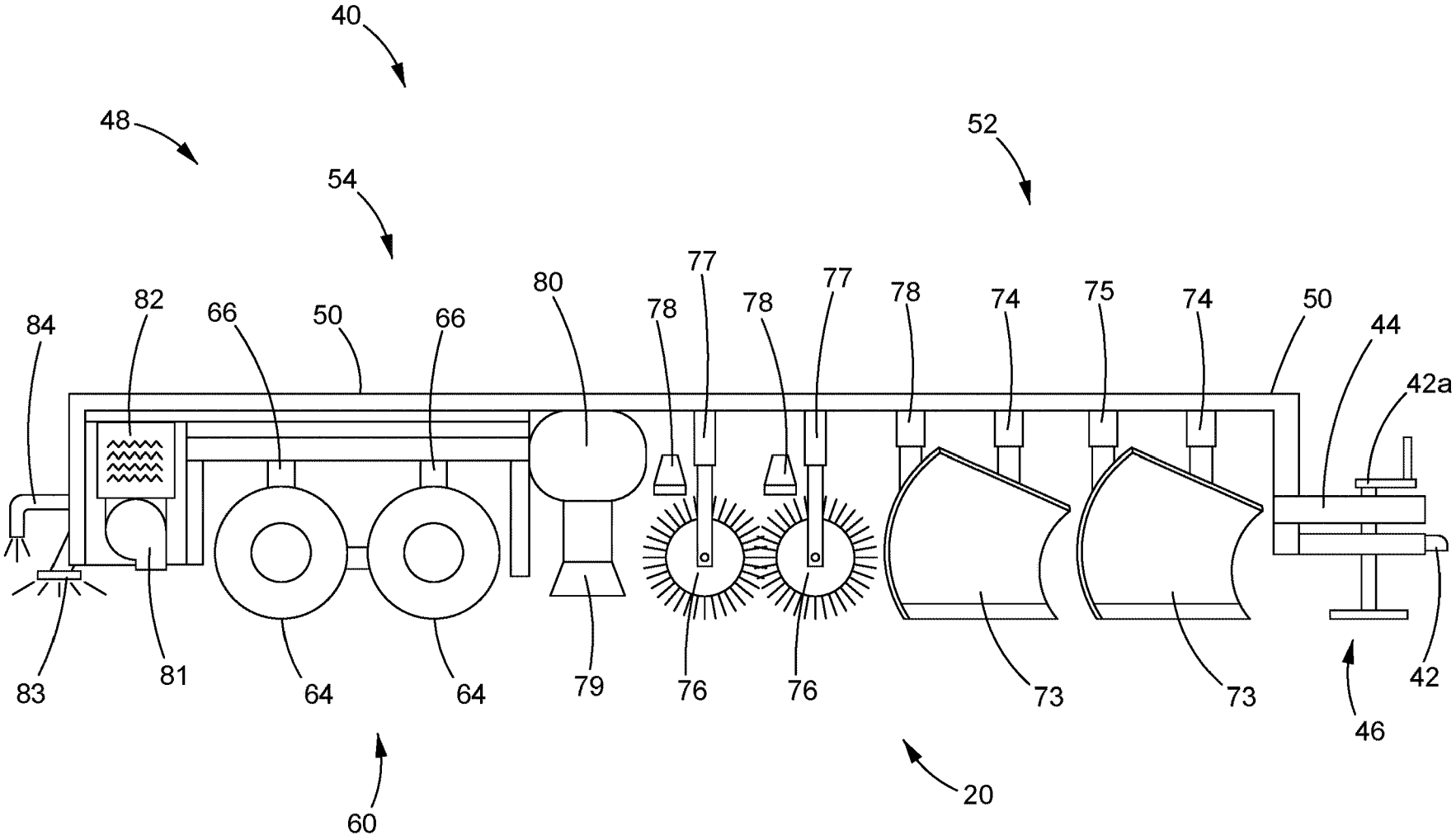
FIG. 1 is a right-side view of the system of the disclosure, where the left-side view is generally a mirror image thereof.

The drawings show some but not all embodiments. The elements depicted in the drawings are illustrative and not necessarily to scale, and the same (or similar) reference numbers denote the same (or similar) features throughout the drawings.

DETAILED DESCRIPTION

In accordance with the practice of at least one embodiment of the invention, as seen in FIGS. 1-5 and 7, for example, there is a system 20 that can be towed behind a vehicle 30 to remove snice 32 from pavement 34. The system includes a trailer 40. The trailer includes a frame structure 50, a trailer hitch 42, and a suspension appliance 60. Frame structure 50 is a longitudinal substantially rigid frame structure with torqueing capability in response to towing of system 20 when removing snice. The hitch 42 is connected to a front end 46 of the trailer. The trailer hitch enables selective connection-disconnection to the vehicle and separation of a front portion 52 of the frame structure from the pavement when connected to the vehicle. That is, the hitch aids the trailer to be consistently positioned substantially horizontally above the pavement at front portion 52 when the trailer is connected to the vehicle. Suspension appliance 60 is connected to a rear portion 48 of the trailer to separate at least a rear portion 54 of the frame structure 50 from the pavement. The suspension appliance includes at least one axel 62 having at least two wheels 64 (i.e., one on each end of the axel) rotatably secured thereto and capable of moving over the pavement, and at least one strut 66 securing the axel to the frame structure. System 20 further includes at least two additive snice removal tools, for example, any of tools 71 to 84 inclusive, connected to the frame structure and located underneath the trailer and over the pavement. In regards to such locating of the tools, "underneath" as used herein only requires that some part of the tool be located underneath the trailer, and this includes on the side of, were one of ordinary skill in the art to define a top most surface of the trailer as an imaginary horizontal plane extending sideways indefinitely and then anything located, in total or in part, under that horizontal plane and relative to the pavement underneath the trailer. Each of the tools, when there is only two, is enabling a different type of snice removal from the pavement when towing the system 20 behind the vehicle to remove snice from the pavement.

Without being limited to a particular theory of understanding, the inventor has surprisingly discovered his system allows for both the front and the rear of the snow removal vehicle to simultaneously be used to plow, clear and ultimately remove snice from pavement. Utilizing both the front and rear of the vehicle is more efficient, effective and productive at removing snice. By utilizing both a vehicle's front-end plow and system 20 towed behind the vehicle, the system is more effective and does a better job of removing snice; which results in clearer, less slippery surfaces and improved drivability on pavement. For example, with system 20, removing snice from pavement can now be done in one pass, versus the usual two or more passes by conventional snow clearing equipment and techniques. Clearer, less slippery driving pavement also means improved safety and fewer accidents/injuries for drivers and reduced number of vehicle crashes and stranded motorists. The present system is also more cost-effective in saving time and money and avoiding having multiple operators, multiple snow removal vehicles, multiple passes by snow removal vehicles, and reducing gas and emissions.

Turning to other particulars of the system 20, the longitudinal substantially rigid aspects to frame structure 50 provide the trailer with torqueing capability in response to towing of system 20 and the forces it will encounter when removing snice. The trailer needs to be generally rigid but have some flexibility as makes sense to one of ordinary skill in the art based on the teachings here, so it can bend and not break in response to road and snice impacts by the trailer and the removal tools. In this regard, preferably the trailer frame structure is constructed of, for example, reinforced square pipe framing which is better equipped to handle torqueing, bending and movement of the frame due to the pressure of pushing heavy snice by the trailer when towed behind the vehicle. That is, trailer 40 is designed and reinforced to withstand heavy pressure from the front portion of the frame structure (i.e., think of pressure horizontally), because of the heavy snice that is being pushed from the front end of the trailer. Much differently, a conventional trailer frame (think of/looks like a bed frame) is designed to withstand heavy weight from on top of the trailer. For example, similar to how a tow truck frame is reinforced from the rear (i.e., horizontal pressure) because it has to tow heavy vehicles from the rear, the present trailer 40 similarly uses this reinforced frame technology, but in the opposite direction (from the front) for trailer 40 and for its removal tools connected thereto.

In other aspects of the system and method, and in part due to its frame structure and orientation of the removal tools, the trailer can be operated at a high rate of speed to keep up with the flow of traffic and not impede or slow down the commute of traffic, especially when the additive snice removal tools are disengaged and in transport/not in use. Further, the system 20 can be utilized behind and by: heavy duty and large-scale municipal snow removal usage and entities, private snow removal company's usage and entities and/or individuals' usage for roadways, streets and driveway's snice removal. As such, the motor vehicle used with the system can be heavy duty municipal trucks, vehicles and earth movers, tractors, Bobcats/ATV's, pickup trucks, passenger automobiles, snow removal machines and/or snowblowers, tractors and skid steers.

The inventor's system is rear connected and towed behind the vehicle utilizing all types and forms of trailer hitches 42 including, but not limited to: standard hitches, rear receiver hitches, fifth wheel hitches, gooseneck hitches, pintle hitches, bumper hitches, weight distribution hitches and/or other types of hitches for towing a trailer behind a moving vehicle. The system can use conventional electrical controls and hydraulic hookups for towed trailers. Further, additionally, the trailer can include at least one trailer stabilizer 44 connected to the frame structure at the front end 46 of the trailer for added durability when needed to more rigidly connect the trailer and vehicle. Stabilizer 44 can be configured to enable selective connection-disconnection to the vehicle, e.g., to its bumper and/or to its rear axle and/or to any other appropriate part of the rear end of the vehicle, and either temporarily to more permanently, to provide additional stability to the trailer in response to towing of the system when removing snice. The system is portable and transportable from one location to another and can be more easily disconnected when not needed, as added benefit when desired. In regards to being disconnected from the vehicle, preferably then a trailer hitch stand 42*a* is connected to trailer 40 in the vicinity of the hitch 42, to be the primary support for the front end of the trailer and keep trailer 40 and the removal tools located underneath the trailer from being damaged by engaging the pavement when system 20 is disconnected from the vehicle.

An added feature of the present system is that the frame structure of the trailer, depending on the size of the frame structure, if it possesses a bed (shown) and sides/walls (not shown), can hold and store: one or more snow removal machines such as ATV's, Bobcats®, snow scrapper(s), brush(es) or snowblowers; one or multiple heavy bags of salt, sand, gravel, etc.; and/or one or multiple large containers of brine, de-icer, etc., and which can add additional weight to the system for additional stability, support and traction when dealing with particularly heavy snow and ice storms and significant accumulation and compaction of snice on pavement.

Figure 2:
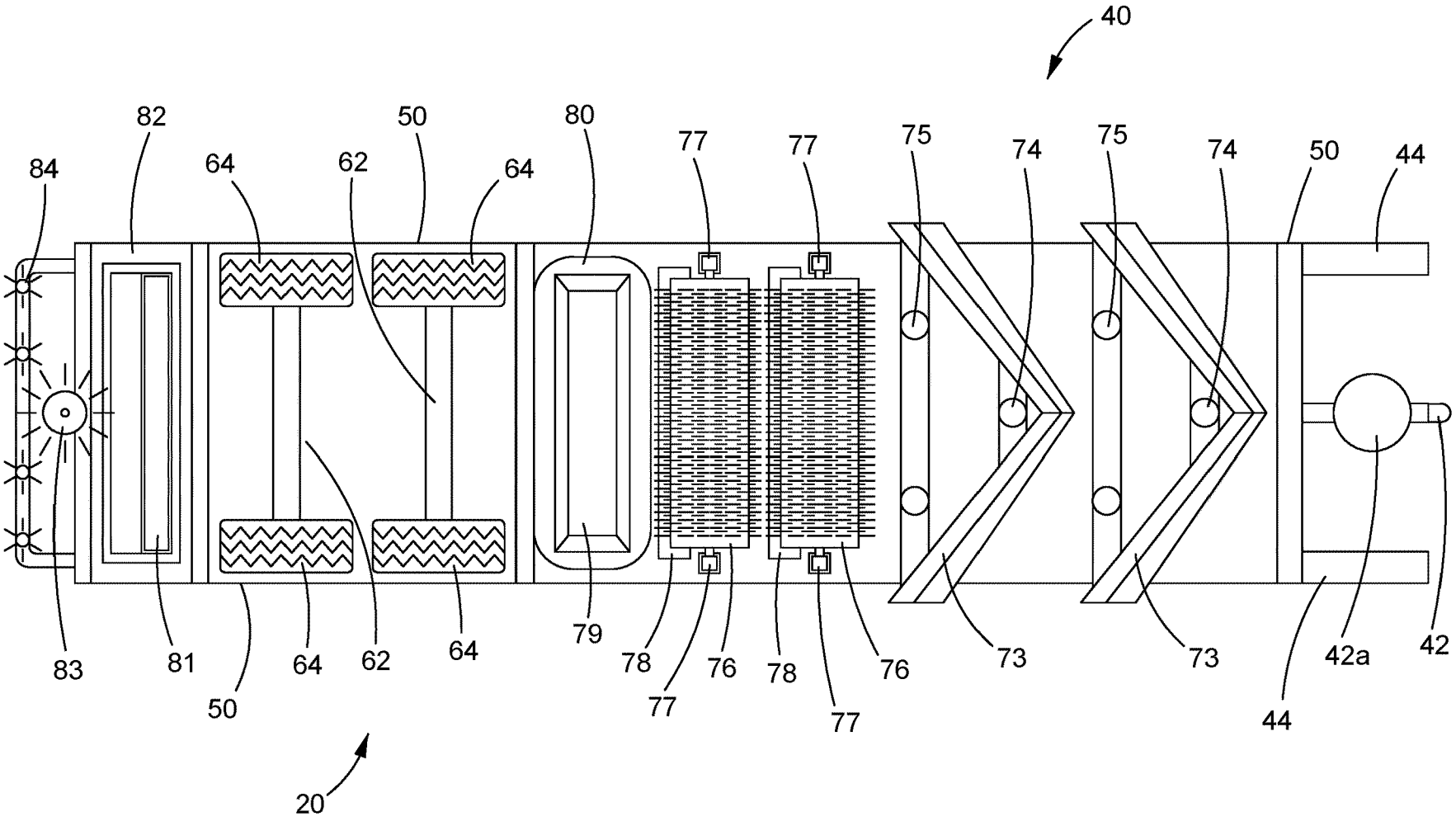
FIG. 2 is a bottom view of that seen in FIG. 1.
Figure 3:
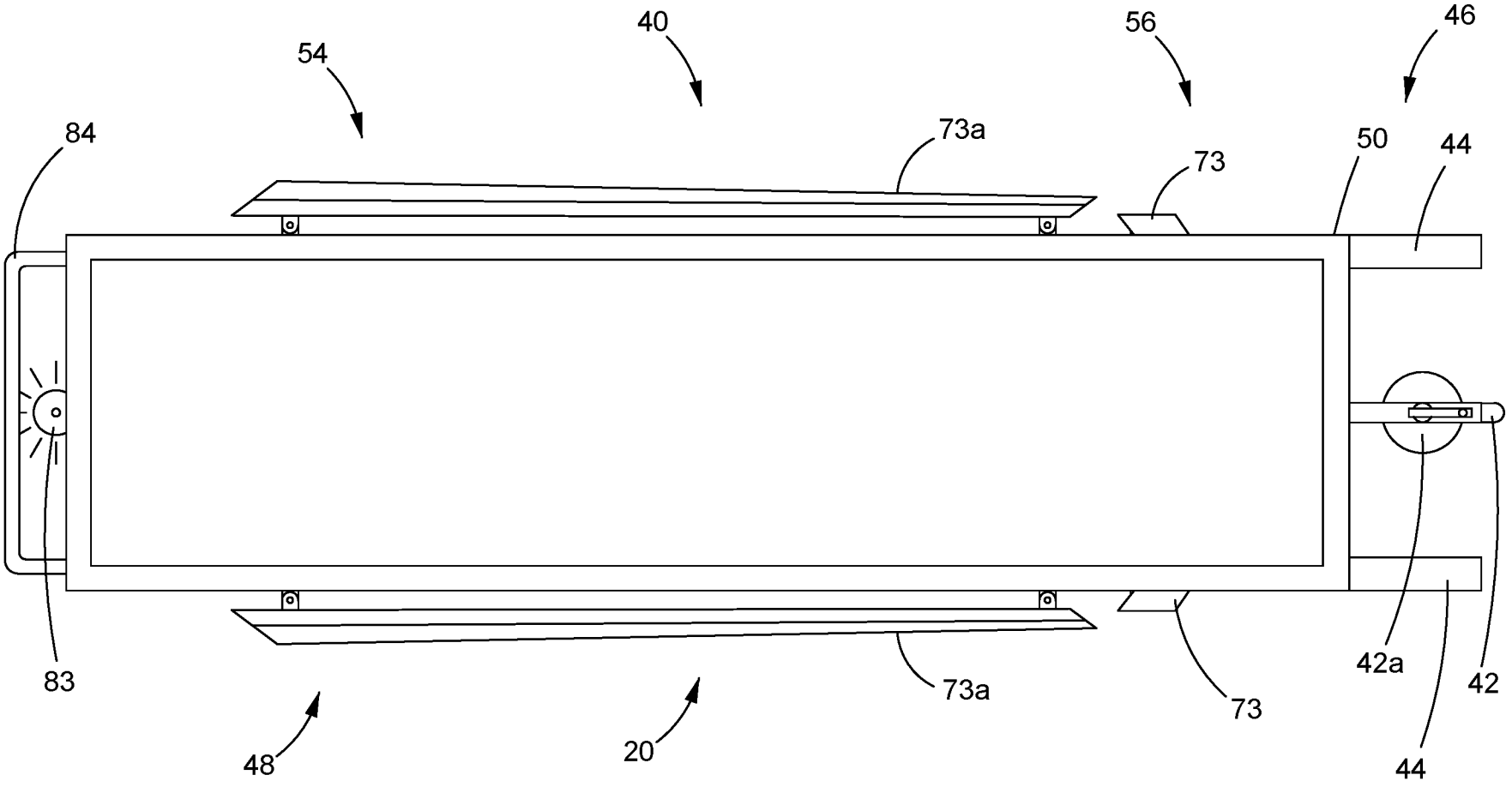
FIG. 3 is a top view of an alternate embodiment of the system of the disclosure, and showing an alternate elongated blade configuration and with the elongated blade in a retracted position.

The removal tools 71 to 84, inclusive, can be disengaged or turned off when not in use, and can be operated manually or through electronic controls and connected mechanisms, and are movable closer and away from the pavement as desired. In one embodiment, at least one of the additive snice removal tools can be a duplicate of such tool. For example, as seen in FIGS. 1 and 2, there are two elongated blades 73 that are substantially the same, and there are also two such rotating brushes 76. Further in this regard, the duplicate of such tool(s) can be placed sequentially behind the tool for a same type of snice removal from the pavement, like with tools 73, 73 and 76, 76. Alternately, the same or similar tools may be placed non-sequentially and indirectly relative to each other and this function or part of removal, as is seen for air blowing tools 78 and 81, and with another type of tool between them.

Figure 6B:
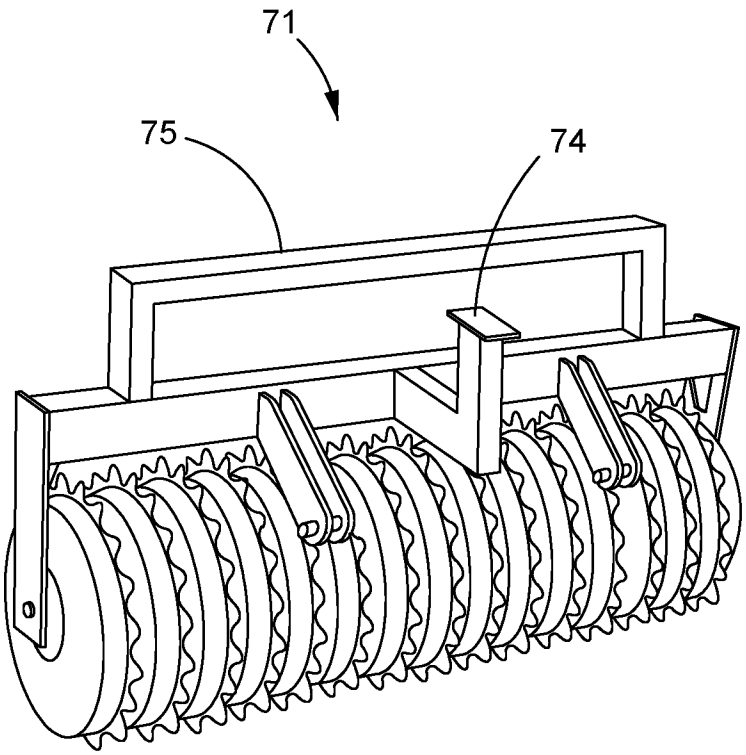
FIG. 6B is a perspective view of yet another additive snice removal tool of the disclosure, as an interchangeable tool.
Figure 6A:
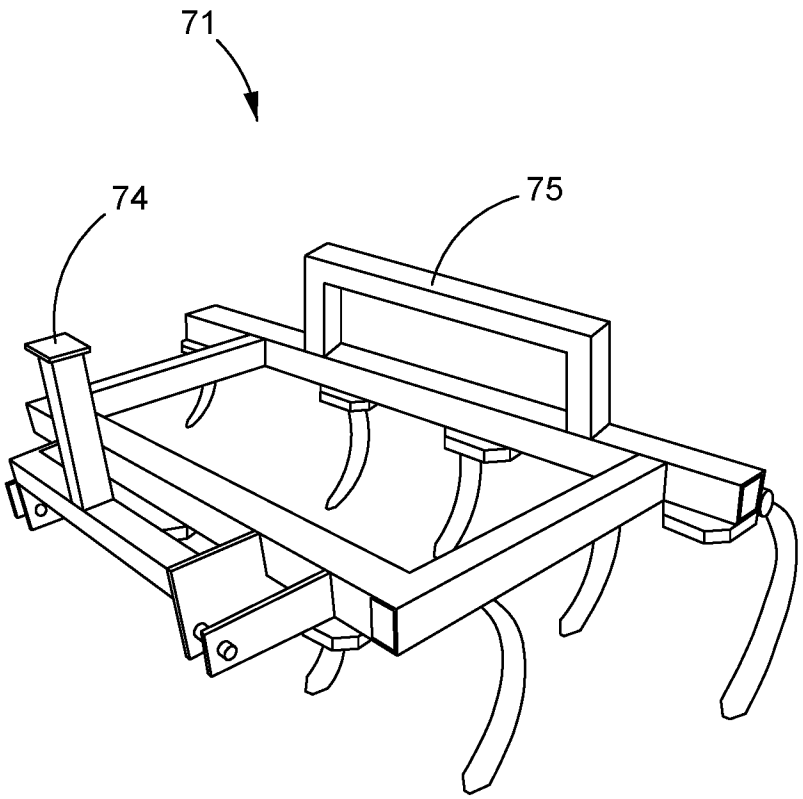
FIG. 6A is a perspective view of still another type of additive snice removal tool of the disclosure, as an interchangeable tool.
Figure 6C:
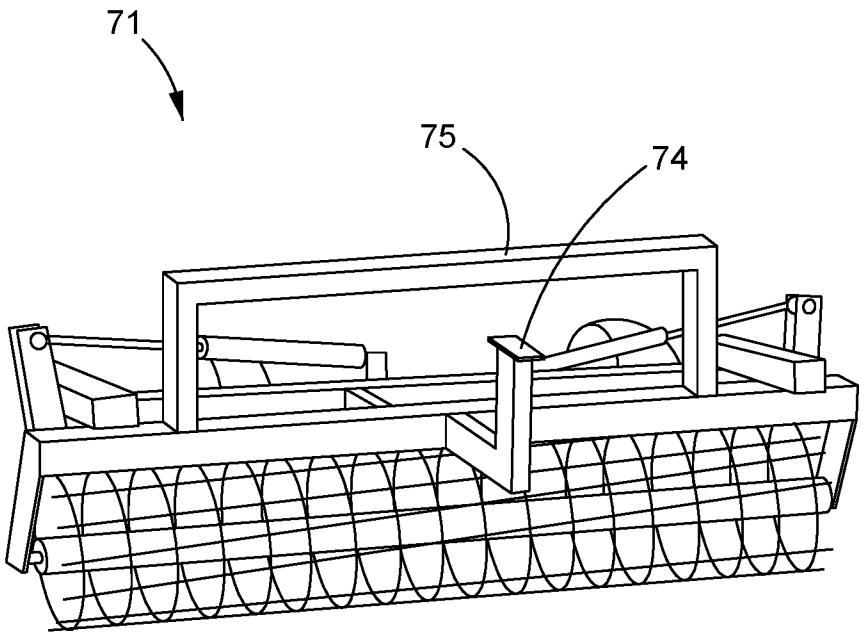
FIG. 6C is a perspective view of still another additive snice removal tool of the disclosure, as an interchangeable tool; and, FIG. 7 is a top view of the system of the disclosure that is being towed behind a vehicle and removing snice from pavement both before and behind the vehicle, and showing the progressively better snice removal if the system depicted here were to move across the page from left to right (relatively speaking) in this Figure.

Without being limited to a theory of understanding, the snice removal tools are considered additive because of their increased efficiency and effectiveness through utilizing multiple methods or techniques of snice removal, and for example, preferably (though only required for at least two), in a specific sequential order when they are system 20 and towed behind a vehicle. Much differently, conventional snice equipment and techniques enable only one or two ways for snice removal, e.g. a front plow truck and a salt spreader on the back of the truck. In other aspects of the system, each additive snice removal tool is a member from the group of choppers 71 (FIG. 6A-chisel plow, FIG. 6B-rotating disc plow, FIG. 6C-spinning disc plow, as three examples of different types of chopping action), elongated blades 73, 73*a* or 73*b*, rotating brush(es) 76, air blowers 78 and 81, snice vacuum 79, solid spreader 83 and liquid sprayer 84. If desired, each additive snice removal tool can be sequentially positioned fora type of snice removal from the pavement that will further lessen an amount of snice remaining on the pavement from the tool in front of it when the system is towed behind the vehicle. For example, further in this regard, sequentially can be at least two members with one following the other, directly or indirectly, such as one of the choppers 71 followed by one or more elongated blade 73, 73*a*, 73*b*, followed by rotating brush(es) 76, followed by air blower(s) 78, 81, followed by snice vacuum 79, followed by solid spreader 83, followed by liquid spreader 84.

Still other features of the system are directed to other particulars of the removal tools. Elongated blades may be like 73 in FIGS. 1-3, or a fuller size blade 73*b* as in FIGS. 4-5 or a side blade 73*a* as in FIGS. 3-4. These blades can be manually or electronically-controlled and are movable snowplow(s)/blade(s)/moldboard(s) to plow snice off pavement and connected (e.g., in front of, to the side of, behind the rear of, underneath and/or on top) to the trailer frame 50. The plow(s)/blade(s)/moldboard(s) can be selectively raised and lowered and move forward, backward, sideways, horizontal, vertical and/or change direction simultaneously or individually, as desired. The size of the plow(s)/blade(s)/moldboard(s) is, preferably, based on the type and extent of usage, whether for usage for and by heavy duty and large-scale municipal snow removal usage and entities, private snow removal companies usage and entities and/or individuals usage for roadways, streets and driveways snice removal. 74 and 75 show one embodiment of non-limiting brackets connecting trailer frame structure 50 to plow(s)/blade(s)/moldboard(s) 73, 73*a*, 73*b*, respectively. Brackets 74 and 75 may also include a shock absorbing function (e.g., with a coil spring, or via pneumatics or other gas charged/pressurized components) and they can assist to brace the trailer from heavy volumes of snice encountered, especially when only encountered periodically and such volume could be particularly jarring on system 20.

Rotating brush(es) 76 are one embodiment of manually or electronically-controlled, movable and rotating scrapper(s)/brush(es) to displace remaining snice off pavement and connected (e.g., in front of, to the side of, behind the rear of, underneath and/or on top) to trailer frame 50. The rotating scrapper(s)/brush(es) 76 can be selectively raised and lowered and move forward, backward, sideways, horizontal, vertical and/or change direction simultaneously or individually, as desired. Bracket(s) 77 are one example for connecting trailer frame 50 to rotating scrapper(s)/brush(es) 76.

Air blower(s) 78 is one embodiment of manually or electronically-controlled blower(s) to displace, and/or melt with heat, remaining snice off pavement and connected (e.g., in front of, to the side of, behind the rear of, underneath and/or on top) to the trailer frame 50. In another embodiment for blower 78, it can be attaching directly to (and directly behind) respective bracket 77 and to the frame and then the embodiment of the blower will break up snice resulting in snice chips and particles on the pavement that then the air blower comes subsequently in the process and blows them away from the driving surface. In the rear portion of the trailer is located second air blower 81, and seen is one embodiment of manually or electronically-controlled heater(s) blowing, and this time preferably with hot air to melt snice on the pavement surface and connected (e.g., in front of, to the side of, behind the rear of, underneath and/or on top) to the trailer frame 50.

A snice vacuum 79 is one embodiment of manually or electronically-controlled vacuum(s) to suction up snice from the pavement and connected (e.g., in front of, to the side of, behind the rear of, underneath and/or on top) to the trailer frame 50. Related to this, holding melting tank 80 is one embodiment of manually or electronically-controlled holding/melting tank for the snice that is suctioned up by the vacuum(s) 79. Heat source 82, for one or more of tank 80, as well as blowers 78, 81, is one embodiment of manually or electronically-controlled heating source(s) used to generate the heat used by the tank 80, and blowers 78, 81, and connected via piping thereto appropriately, to melt the snice.

Finally, in the rear portion 48 of the trailer, can be a couple different types of dispersing tools. There is one embodiment of manually or electronically-controlled salt/sand/gravel spreader(s) 83 to melt snice on the pavement and improve driveability and connected (e.g., in front of, to the side of, behind the rear of, underneath and/or on top) to trailer frame 50. In another embodiment there is manually or electronically-controlled de-icer/brine sprayer(s) 84 to melt snice on pavement and improve driveability and connected (e.g., in front of, to the side of, behind the rear of, underneath and/or on top) to the trailer frame 50.

Figure 4:
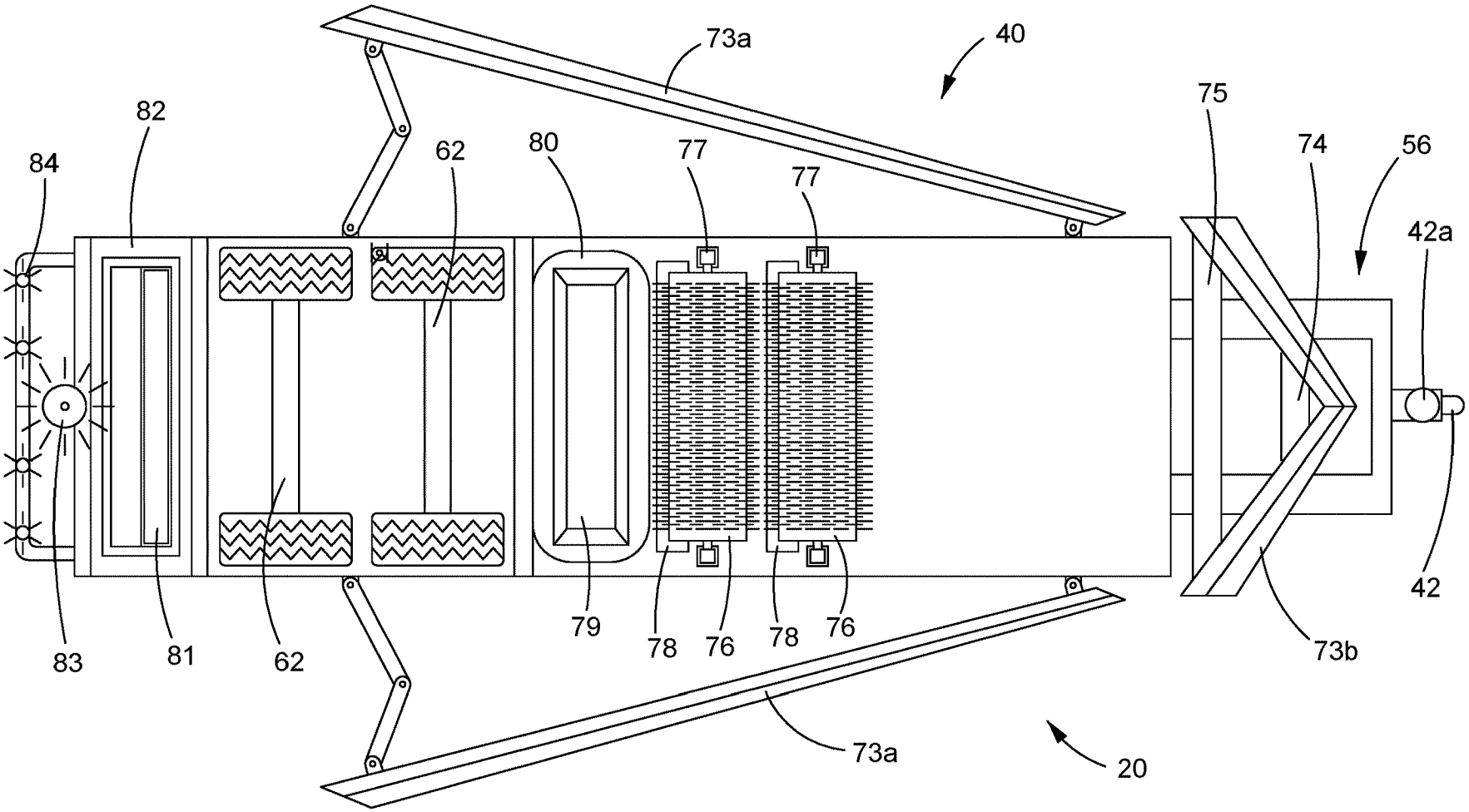
FIG. 4 is a bottom view similar to that seen in FIG. 3 but of another alternative embodiment, and with the elongated blade configuration in a partially extended position and also showing an alternate hitch area frame structure.
Figure 5:
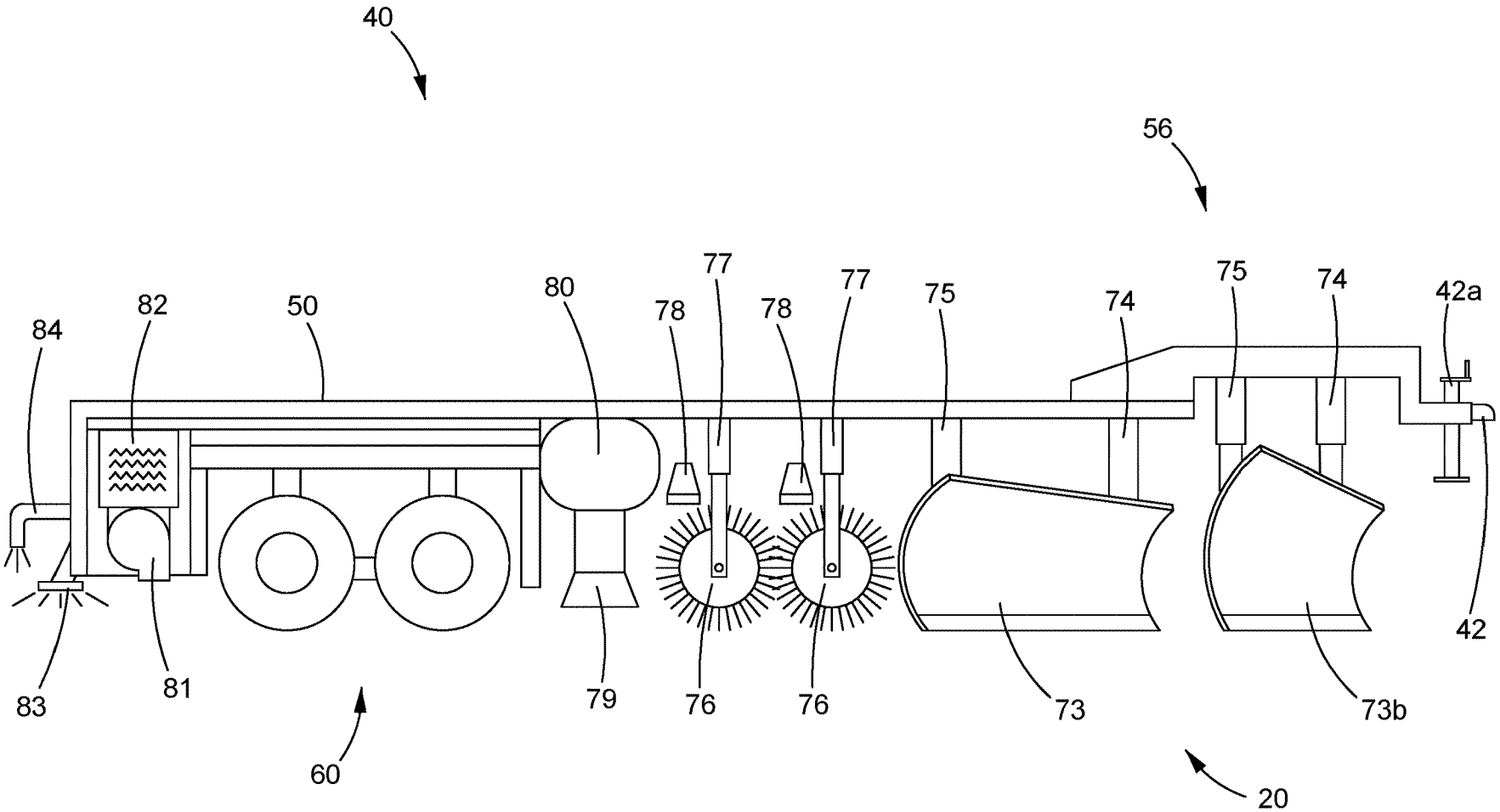
FIG. 5 is a side view of yet an alternate embodiment of the system of the disclosure, where the left-side view is generally a mirror image thereof, and showing the hitch area frame structure and without the elongated blade.

Specifically in reference to FIGS. 4 and 5, in yet other embodiments of the system, there may be a hitch area substantially rigid frame structure 56 with torqueing capability in response to towing of the system when removing snice. The hitch area 56 is located between the trailer hitch 42 and the front end 46 of the trailer. Area 56 is a raised area as compared to the rest of the trailer 40, in order to add, if desired, a removal tool closer to the back end of the vehicle and yet still enable hitching ability to the vehicle. The frame structure 56 preferably is constructed to have the torqueing capability as discussed earlier for the trailer frame structure 50. The trailer hitch stand 42*a* seen in FIGS. 4 and 5, preferably has extension capability to engage the pavement when the system is disconnected from the vehicle. As a further feature for area 56, at least one additive snice removal tool can be connected to the hitch area frame structure and located underneath this frame structure and over the pavement. For example, preferably tool 73*b* or any of tools 71 are interchangeable via brackets 74, 75 to go in area 56 during various snice removal conditions. And additionally, if desired, each of the tools in area 56 is enabling a different type of snice removal from the pavement, to further aid in the overall possible effectiveness and efficiency of system 20.

Figure 7:
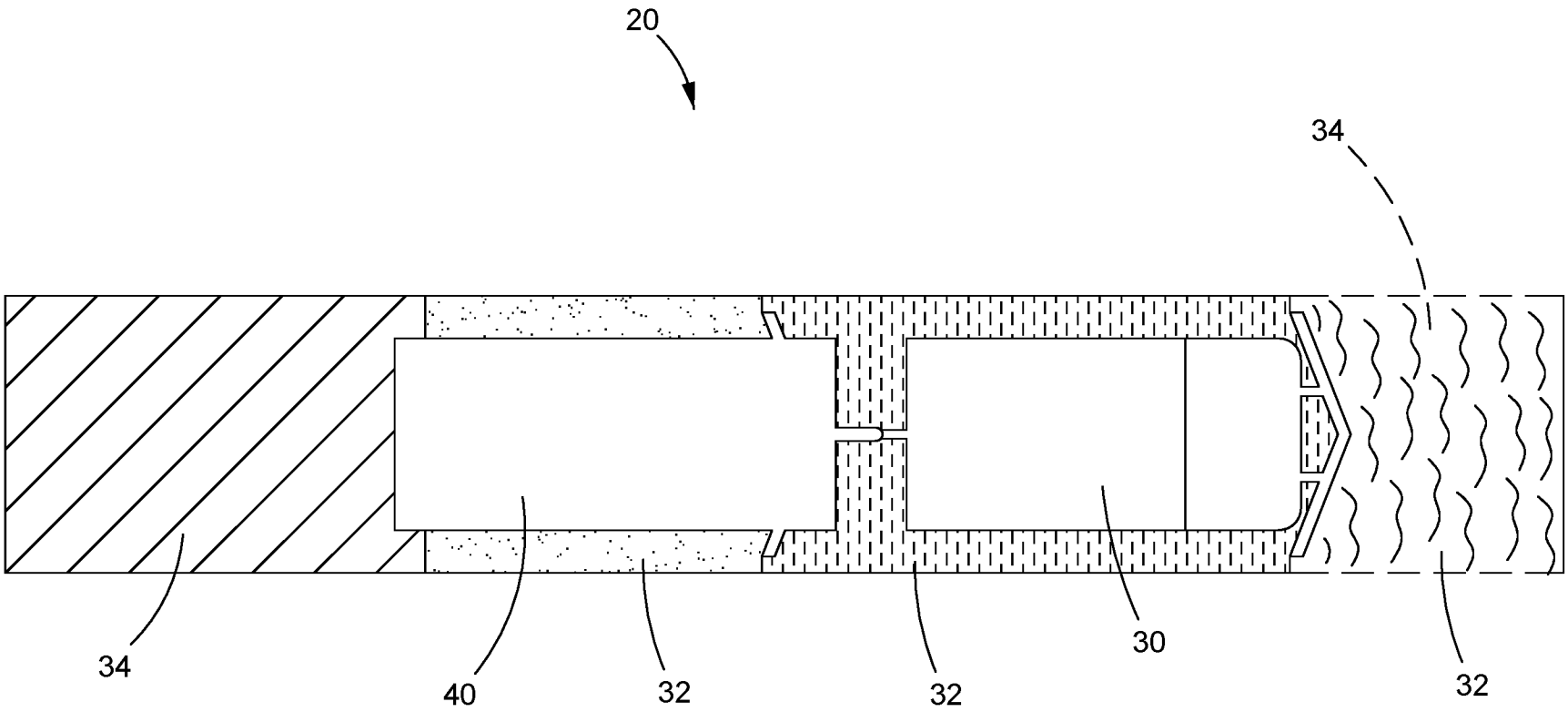

The present disclosure is also directed to a method of using system 20 behind vehicle 30 for removing snice 32 from pavement 34. As seen in FIG. 7, there is vehicle 30 that is towing system 20 as they first encounter snice 32 in the form of more snow than ice (the right side of the page) and depicted in wavy lines. The vehicle front plow removes much of the first encountered snice to get a clearer area alongside and behind vehicle 30, as seen in dashed lines next. Then, system 20 removes even more snice leaving only some snice represented by light stippling in the figure alongside system 20. Finally, after system 20 completely passes over the snice covered pavement, then substantially all snice is removed and represented by solid angled lines following system 20 on the completely snice removed pavement area behind system 20.

Stated further, and exemplified in the various embodiments of the method of using system 20 as described herein, it is better able to adapt to changing weather conditions during the phases of a blizzard/snowstorm than any conventional snow and ice clearing system. For example, when there is a heavy snowstorm it often goes through four stages. First, there is rapid temperature decline and precipitation converts from liquid to snow. During this phase, system 20 will be primarily utilizing its spreader 83 and sprayer 84 along with the elongated blades 73, 73*b* and brush(es) 76 to address this initial storm stage (i.e., rain, sleet, hail and heavy snow fall). Second, there is blanket snow. During this snow/blizzard phase, system 20 engages its chopper tools 71, elongated blades 73, 73*a*, and elongated wings 73*a* and brush(es) 76 as the primary focus of use. Third, there is reduction in snowfall. During this snow/blizzard phase, system 20 will be utilizing all features in combination to remove heavy snow from pavement and the beginning stages of removing the crust of the compacted snice on the pavement. For the fourth and final stage in our example, there is dry pavement. During this snow/blizzard phase, system 20 will be utilizing the brush(es) 76, blower(s) 78 and 81, heating source 82 in combo with blower(s) 78 and 81 and snice vacuum 79 to suck up and eliminate any final snice on the pavement.

The method includes various steps, and they can be in various order as desired and stated herein. A first step is towing the trailer 40 behind the vehicle, the trailer including the longitudinal substantially rigid frame structure with torqueing capability in response to towing of the trailer when removing snice. Another step is selectively connecting the trailer to the vehicle and separating the front portion of the frame structure from the pavement when the trailer is connected to the vehicle. There is also a step of providing the suspension appliance to the rear portion of the trailer to separate at least the rear portion of the frame structure from the pavement. In this step, the suspension appliance includes at least one axel having at least two wheels rotatably secured thereto and capable of moving over the pavement and at least one strut securing the axel to the frame structure. And, in its most simple form, a final step is enabling at least two different types of additive snice removal from the pavement when towing the trailer behind the vehicle to remove snice from the pavement.

To further practice additional, preferred, aspects of the method, other steps may be employed, as follows. The step of enabling can be connecting at least two additive snice removal tools to the frame structure and locating them underneath the trailer and over the pavement. Alternately, or additionally, enabling can be two steps of the same type of additive snice removal from the pavement and one step of a different type of additive snice removal from the pavement, e.g., one blade 73 followed by two brushes 76. Alternately, for example, the two steps of the same type of additive snice removal from the pavement can both precede the one step of the different type of additive snice removal from the pavement, e.g., two blades 73 followed by one brush 76.

Yet additionally, another step can be locating before the front end 46 of the trailer 40 a hitch area substantially rigid frame structure 56 with torqueing capability in response to towing of the trailer 40 when removing snice. Further in this regard, the method may include enabling at least one type of additive snice removal in proximity to the hitch area 56 when towing the trailer behind the vehicle to remove snice from the pavement. And further, if desired, each enabling step can be for a different type of additive snice removal from the pavement.

In other aspects, the method may include each additive snice removal type is a member from the group of tools 71, 73 (including 73*a*, 73*b*), 76, 78/81, 79, 83 or 84, to enable, respectively, chopping, elongated blading, rotary brushing, air blowing, snice vacuuming, solid spreading and/or liquid spraying. Further in this regard, preferably, the enabling step includes sequentially staging each additive snice removal type to further lessen an amount of snice remaining on the pavement from the additive snice removal step that preceded it when the trailer is towed behind the vehicle for snice removal from the pavement. Still further in this regard, preferably, the sequentially staging step includes at least two members one following the other, directly or indirectly, from the group of: chopping followed by elongated blading, followed by rotary brushing, followed by air blowing, followed by snice vacuuming, followed by solid spreading, followed by liquid spreading.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the pavement snice clearing, removing, lessening arts, and all such modifications and other embodiments are intended and deemed to be within the scope of the present invention.

What is claimed is:

1. A system that is towed behind a vehicle comprising a pickup truck, a passenger automobile, or an All-Terrain-Vehicle to remove snice from pavement comprising:

a trailer comprising:

a longitudinal substantially rigid frame structure with torqueing capability in response to towing of the system when removing snice, a trailer hitch connected to a front end of the trailer wherein the trailer hitch enables selective connection-disconnection to the vehicle and separation of a front portion of the frame structure from the pavement when connected to the vehicle, a suspension appliance connected to a rear portion of the trailer to separate at least a rear portion of the frame structure from the pavement wherein the suspension appliance comprises at least one axel having at least two wheels rotatably secured thereto and capable of moving over the pavement and at least one strut securing the axel to the frame structure, and wherein the longitudinal substantially rigid frame structure with torqueinq capability comprises a horizontal top frame portion: (i) bounded by the front portion of the frame structure vertically oriented and extending toward the pavement (ii), bounded by the rear portion of the frame structure vertically oriented and extending toward the pavement, and (iii) including a closed, flat top storage bed; and, at least two snice removal tools connected to the frame structure and located underneath the trailer and over the pavement wherein at least one of the snice removal tools is contained completely inside a vertically projecting profile defined by outer sides of the horizontal top frame portion, each of the snice removal tools enabling a different type of snice removal from the pavement when towing the system behind the vehicle to remove snice from the pavement.

2. The system of claim 1, wherein at least one of the snice removal tools comprises a duplicate snice removal tool.

3. The system of claim 2, wherein the duplicate of the snice removal tool is placed sequentially behind the tool for a same type of snice removal from the pavement.

4. The system of claim 1, further comprising a hitch area substantially rigid frame structure with torqueing capability in response to towing of the system when removing snice, the hitch area located between the trailer hitch and the front end of the trailer.

5. The system of claim 4, further comprising at least one snice removal tool connected to the hitch area frame structure and located underneath the frame structure and over the pavement.

6. The system of claim 5, wherein each of the tools enabling a different type of snice removal from the pavement.

7. The system of claim 1, further comprising at least one trailer stabilizer connected to the frame structure at the front end of the trailer and configured to enable selective connection-disconnection to the vehicle to provide additional stability to the trailer in response to towing of the system when removing snice.

8. The system of claim 1, wherein each snice removal tools is a member from the group comprising chopper, elongated blade, rotating brush, air blower, snice vacuum, solid spreader and liquid sprayer.

9. The system of claim 8, wherein each snice removal tool is sequentially positioned for a type of snice removal from the pavement that will lessen an amount of snice remaining on the pavement from the tool in front of it when the system is towed behind the vehicle.

10. The system of claim 9, wherein sequentially positioned comprises at least two members one following the other, directly or indirectly, from the group of: chopper, elongated blade, rotating brush, air blower, snice vacuum, solid spreader, liquid spreader.

11. A method of using a system behind a vehicle comprising a pickup truck, a passenger automobile, or an All-Terrain-Vehicle for removing snice from pavement comprising the steps:

towing a trailer behind the vehicle, the trailer comprising a longitudinal substantially rigid frame structure with torqueing capability in response to towing of the trailer when removing snice;

selectively connecting the trailer to the vehicle and separating a front portion of the frame structure from the pavement when the trailer is connected to the vehicle;

providing a suspension appliance to a rear portion of the trailer to separate at least a rear portion of the frame structure from the pavement wherein the suspension appliance comprises at least one axel having at least two wheels rotatably secured thereto and capable of moving over the pavement and at least one strut securing the axel to the frame structure, wherein the longitudinal substantially rigid frame structure with torqueing capability comprises a horizontal top frame portion: (i) bounded by the front portion of the frame structure vertically oriented and extending toward the pavement (ii), bounded by the rear portion of the frame structure vertically oriented and extending toward the pavement, and (iii) including a closed, flat top storage bed; and, enabling at least two different types of snice removal from the pavement when towing the trailer behind the vehicle to remove snice from the pavement.

12. The method of claim 11, wherein enabling comprises connecting at least two snice removal tools to the frame structure and locating them underneath the trailer and over the pavement and wherein at least one of the snice removal tools is contained completely inside a vertically projecting profile defined by outer sides of the horizontal top frame portion.

13. The method claim 11, wherein enabling comprises two steps of a same type of snice removal from the pavement and one step of a different type of snice removal from the pavement.

14. The method of claim 13, wherein the two steps of a same type of snice removal from the pavement both precede the one step of the different type of snice removal from the pavement.

15. The method of claim 11, further comprising locating before a front end of the trailer a hitch area substantially rigid frame structure with torqueing capability in response to towing of the trailer when removing snice.

16. The method of claim 15, further comprising enabling at least one type of snice removal in proximity to the hitch area when towing the trailer behind the vehicle to remove snice from the pavement.

17. The method of claim 16, wherein each enabling step is for a different type of snice removal from the pavement.

18. The method of claim 11, wherein each snice removal type is a member from the group comprising chopping, elongated blading, rotary brushing, air blowing, snice vacuuming, solid spreading and liquid spraying.

19. The method of claim 18, wherein enabling comprises sequentially staging each snice removal step to lessen an amount of snice remaining on the pavement from the snice removal step that preceded it when the trailer is towed behind the vehicle for snice removal from the pavement.

20. The method of claim 19, wherein sequentially staging comprises at least two members one following the other, directly or indirectly, from the group of: chopping, blading, rotary brushing, air blowing, snice vacuuming, solid spreading, liquid spreading.

21. The method of claim 11, further comprising selectively disconnecting the trailer from the vehicle when the trailer is not needed for snice removal from the pavement.

22. The method of claim 11, wherein enabling comprises connecting at least two snice removal tools to the frame structure and locating them underneath the trailer and over the pavement, and further comprising selectively adjusting the use of the at least two snice removal tools based on type of snice removal desired.

23. The method of claim 21, wherein the step of adjusting comprises electronically-controlled adjusting.

* * * * *